US011028864B2

(12) United States Patent
Metschke et al.

(10) Patent No.: US 11,028,864 B2
(45) Date of Patent: Jun. 8, 2021

(54) METHOD AND APPARATUS FOR CONTROLLING A DOUBLE-ACTING PNEUMATIC ACTUATOR

(71) Applicant: FISHER CONTROLS INTERNATIONAL LLC, Marshalltown, IA (US)

(72) Inventors: Christopher S. Metschke, Ames, IA (US); Michael R. Fontaine, Marshalltown, IA (US); Kenneth W. Junk, Marshalltown, IA (US); David L. Smid, Marshalltown, IA (US)

(73) Assignee: FISHER CONTROLS INTERNATIONAL LLC, Marshalltown, IA (US)

( * ) Notice: Subject to any disclaimer, the term of this patent is extended or adjusted under 35 U.S.C. 154(b) by 62 days.

(21) Appl. No.: 16/144,877

(22) Filed: Sep. 27, 2018

(65) Prior Publication Data

US 2019/0101141 A1 Apr. 4, 2019

Related U.S. Application Data

(60) Provisional application No. 62/565,929, filed on Sep. 29, 2017.

(51) Int. Cl.
*F15B 15/28* (2006.01)
*F15B 11/042* (2006.01)
(Continued)

(52) U.S. Cl.
CPC ..... *F15B 15/2815* (2013.01); *F15B 11/042* (2013.01); *F15B 11/044* (2013.01);
(Continued)

(58) Field of Classification Search
None
See application file for complete search history.

(56) References Cited

U.S. PATENT DOCUMENTS 5,424,941 A * 6/1995 Bolt ..... G05B 19/358 137/625.65
2006/0037466 A1 2/2006 Yajima et al.
2009/0199703 A1 8/2009 Hoffmann et al.

OTHER PUBLICATIONS

Xiangrong Shen et al., "Simultaneous Force and Stiffness Control of a Pneumatic Actuator", Journal of Dynamic Systems, Measurement and Control, vol. 129, No. 4, 2017.

(Continued)

*Primary Examiner* — Mohammad Ali
*Assistant Examiner* — Saad M Kabir
(74) *Attorney, Agent, or Firm* — Marshall, Gerstein & Borun LLP

(57) ABSTRACT

A control loop for a double-acting pneumatic actuator is configured to generate two control signals, one for each of the two pneumatic chambers for the purpose of controlling the actuator position in view of operating constraints on the chamber pressures or the stiffness of the actuator. A numerical indicator of the stiffness may be computed in a variety of ways, for example, as the average of the two chamber pressures. In one embodiment a numerical indicator of stiffness is treated as an output of the system along with the position of the actuator. A multi-input multi-output control loop with position and pressure feedback may be used to simultaneously control the position and the stiffness of the actuator.

16 Claims, 4 Drawing Sheets

(51) Int. Cl.
*F15B 11/044* (2006.01)
*F15B 15/14* (2006.01)
*F15B 15/20* (2006.01)

(52) U.S. Cl.
CPC ..... *F15B 15/149* (2013.01); *F15B 15/202* (2013.01); *F15B 2211/6303* (2013.01); *F15B 2211/6313* (2013.01); *F15B 2211/7053* (2013.01); *F15B 2211/7055* (2013.01); *F15B 2211/7656* (2013.01)

(56) References Cited

OTHER PUBLICATIONS

International Search Report and Written Opinion, for International Application No. PCT/US2018/051837, dated Jan. 23, 2019.

* cited by examiner

METHOD AND APPARATUS FOR CONTROLLING A DOUBLE-ACTING PNEUMATIC ACTUATOR

FIELD OF THE TECHNOLOGY

The present invention generally relates to control valves and, more particularly, to methods and apparatus for controlling a double-acting pneumatic actuator for a process control valve.

BACKGROUND INFORMATION

Many industrial processes use control valves to control the flow rates of fluids through pipes. These control valves are opened and closed by actuators, the positions of which are set by positioners using feedback from actuator position sensors and process settings. The goal of the positioner and actuator combination is to quickly and accurately control actuator position and to minimize deviations in the actuator position in response to the forces generated by the process fluids flowing through the valve.

A double-acting pneumatic actuator changes position by adjusting pressures in two pneumatic chambers, where the pressures push on a piston connected to a stem. The stem, in turn, translates the motion of the piston to adjust an opening of a control valve to change the flow of a process fluid. When the forces from the flow of process fluid move the actuator, the process may be adversely affected, and additional wear on actuator components may reduce the life of the actuator. Stiffness of the actuator presents an engineering trade-off between being able to rapidly control the actuator position and limiting the effect of the buffeting forces in the valve on fluctuations in the position of the actuator. Reducing undesired variations in stiffness of valve actuators would improve the quality and the durability of the process control system.

SUMMARY

Implementations of methods and corresponding systems of this disclosure can control the position of a double-acting pneumatic actuator in view of constraints set on the stiffness of the actuator. The system can increase the stiffness by increasing the opposing pressures in the two pneumatic chambers and decrease the stiffness, conversely, by decreasing the two pressures. Thus, by controlling the two pneumatic signals to the actuator chambers, the disclosed methods can change the position of the actuator while simultaneously increasing or decreasing the stiffness.

The system can be configured to measure the pressures in the two chambers and use the measurements to compute a numerical indicator of stiffness. A control loop can be configured to use the numerical indicator of stiffness as one of the outputs to control, along with controlling the position of the actuator.

The method for controlling the actuator may include: obtaining a constraint on a numerical indicator of the stiffness of the actuator and obtaining a set point for the position of the actuator, measuring the position of the actuator, computing the numerical indicator of the stiffness of the actuator, computing control signals to adjust the pressures in the two pneumatic chambers so as to minimize an error in the position of the actuator in view of the constraint on the numerical indicator of the stiffness of the actuator, and/or activating pneumatic devices to adjust the pressures in the pneumatic chambers of the actuator in response to the control signals.

Alternatively, the method can use the measured pressures (without necessarily calculating the indicator of the stiffness) by: obtaining a set point for the position of the actuator, measuring the position of the actuator, measuring sensor outputs indicative of the pressures in the two chambers of the actuator, using measured position and the two measured pressures in computing control signals to adjust the pressures in the two pneumatic chambers so as to minimize the error in the position of the actuator, and/or activating pneumatic devices to adjust the pressures in the pneumatic chambers of the actuator in response to the control signals.

Different implementations may define the constraint on the stiffness of the actuator or constraints on the pressures in the pneumatic chambers of the actuator in different ways. Some implementation may define the constraints on the pressures in the chambers by setting minimum and/or maximum pressure values for one or each of the chambers, setting target pressures (i.e. set points) for the pressures in one or each of the chambers, or defining an indicator as a mathematical combination of the pressure values (such as an average) in the two chambers, and giving the indicator a corresponding set point or an acceptable range. Some implementations may define the numerical indicator of the stiffness of the actuator as a mathematical combination (such as a weighted sum) of the pressure values in the two chambers, or include position measurements in the definition and the computation of the indicator. These implementations may define corresponding constraints as acceptable ranges in the indicators of the stiffness, or as a set point in the indicators of the stiffness.

Different implementations may compute control signals in different ways. In some implementations, the constraints may set whether the pressure in a given chamber will increase or decrease, and the position error will set the corresponding magnitudes of the increase or the decrease. Alternatively, multi-input multi-output (MIMO) control loops can use an error in the indicator of the stiffness or an error in pressure, along with an error in position, to compute the control signals for each of the two chambers. These computations may comprise calculating a weighted sum of the error in the position of the actuator, a velocity of the actuator, and the error in the numerical indicator of the stiffness of the actuator (or the error in a chamber pressure).

Additionally, different implementations can translate the computed control signals into pneumatic signals generated by pneumatic devices in different ways. In some implementations, the magnitudes of the control signals may set the magnitudes of flow rates or pressures generated by the pneumatic devices. In other implementations, the control signals may activate each of the pneumatic devices to provide a constant flow rate for a duration consistent with the magnitude of the corresponding control signal.

DETAILED DESCRIPTION

Figure 1:
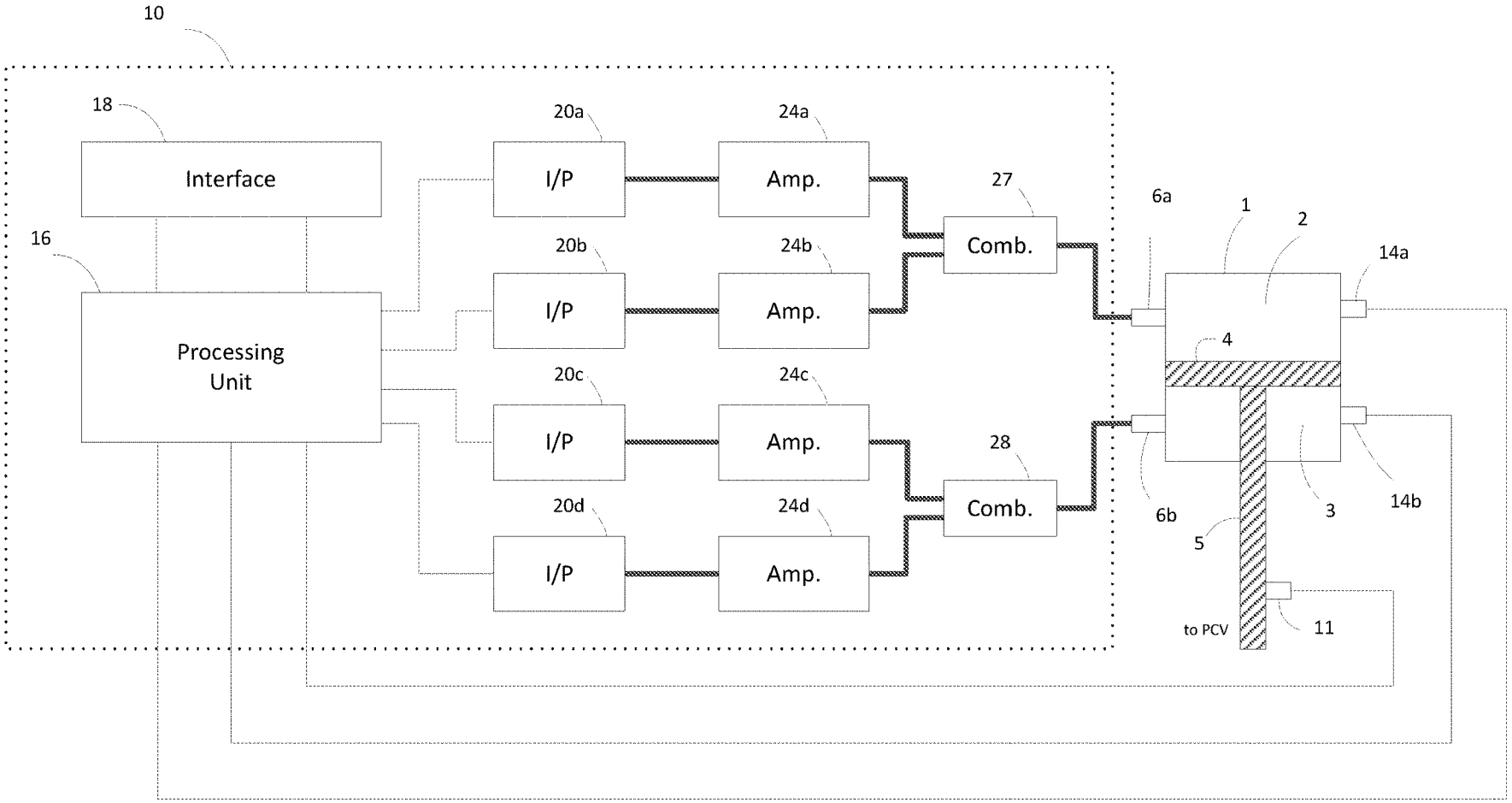
FIG. 1 is a block diagram of an example positioning system configured to control a double-acting pneumatic actuator.

FIG. 1 illustrates an implementation of a system comprising a double-acting actuator 1 and a positioner 10 for controlling the actuator 1. The positioner 10 can comprise the advanced functionality of a digital valve controller (DVC), but FIG. 1 does not illustrate this functionality. The actuator 1 has an upper pneumatic chamber 2 and a lower pneumatic chamber 3, separated by a piston 4 which is attached to a stem 5 connected to a process control valve (PCV). The process control valve may control fluid flow within a process control system, such as a chemical or other process control plant. Chamber 2 has an outlet 6*a* which can supply air or another control fluid, or conversely exhaust the control fluid from chamber 2. Likewise, chamber 3 has an outlet 6*b* which can supply or exhaust the control fluid of chamber 3. As the amount of control fluid changes in one or both of the actuator chambers 2 and/or 3, the piston 4 and the attached stem 5 move to a new position.

An implementation of the double-acting actuator 1 can also contain a spring (not shown) in one of the chambers for fail-open or fail-closed action. The spring would place the actuator at one limit of the actuator's range when, for example, the chambers depressurize due to a leak. The spring can offset the balance between the two chamber pressures.

In some implementations, a mechanism in an alternative actuator can translate the linear motion of the pistons into rotary motion of the stems by means of rack and pinion, scotch yoke, or another mechanism. These implementations can contain more than one piston and more than two chambers.

Position sensor 11 is configured to detect the position of the actuator 1. While in the illustrated implementation this position indicates a linear displacement of the stem 5, in implementations with an alternative rotary actuator, an alternative sensor can be configured to measure angular displacement of some portion of the alternative rotary actuator. Pressure sensors 14*a* and 14*b* are configured to indicate the pressures in chambers 2 and 3, respectively. The pressure sensors can be located at the outlet ports 6*a-b* for the chambers. The sensors can also be integrated into the body of the positioner 10 at locations which are fluidly connected to the chambers 2 and 3 by pneumatic lines. Sensors 11, 14*a* and 14*b* communicatively couple to the processing unit 16.

The processing unit 16 is configured to detect outputs of position and pressure sensors 11, 14*a* and 14*b*. The processing unit 16 is communicatively coupled to the interface 18. In one implementation, the processing unit 16 can comprise a microprocessor. In other implementations, the processing unit 16 can comprise field programmable gate arrays (FPGAs) or analog circuits. The processing unit 16 is configured to output electrical control signals to the pneumatic devices. The processing unit 16 can also be configured to compute other signals, such as diagnostic information about the positioner and the actuator.

The interface 18 can include wired and wireless connections, circuitry for communications and signal processing, non-transient memory and a human-machine interface. Thus, the processing unit 16 can obtain set points and constraints for controlling the actuator in a variety of ways. The set point of position may be a dynamically changing value which is communicated by a process controller to the interface 18 using a predetermined communication protocol. The constraint on the stiffness of the actuator may or may not change dynamically. In implementations with preset constraints on the stiffness, the processing unit 16 may use the interface 18 to retrieve the stiffness constraint by accessing nonvolatile memory where the constraint can be stored.

The implementation shown in FIG. 1 uses four current-to-pressure (I/P) transducers 20*a-d* to generate pneumatic signals for the actuator. The transducers 20*a-d* are communicatively coupled to the processing unit 16. Four transducers can be used in implementations in which each of the transducers is configured for activating flow in one direction. I/P transducer 20*a* and the corresponding pneumatic amplifier 24*a* are fluidly connected to the supply of pressurized control fluid, while 20*b* and the corresponding pneumatic amplifier 24*b* are fluidly connected to the exhaust at low pressure. The supply and exhaust pneumatic paths fluidly combine in the pneumatic summation component 27 and connect to the outlet 6*a* of the upper chamber 2. Analogously, I/P transducer 20*c* and the corresponding pneumatic amplifier 24*c* are fluidly connected to the supply of pressurized control fluid, while 20*d* and the corresponding pneumatic amplifier 24*d* are fluidly connected to the exhaust at low pressure. The supply and exhaust pneumatic paths fluidly combine in the pneumatic summation component 28 and connect to the outlet 6*b* of the lower chamber 3. In some implementations, a single pneumatic device can combine multiple pneumatic functions. For example, the same device can comprise pneumatic amplifiers 24*a*, 24*b* and the pneumatic summation component 27.

In operation, the processing unit 16 communicates to the interface 18 to obtain the set point of position as well as a constraint on the stiffness of the actuator 1. The processing unit 16 also reads the sensors 11, 14*a* and/or 14*b* to obtain the displacement of the actuator and/or the pressures in the chambers 2 and 3 of the actuator 1. For any given implementation, the processing unit 16 can compute a numerical indicator of the stiffness of an actuator from the collected sensor data in accordance to the way that the constraint on the numerical indicator of the stiffness of the actuator is defined. In one implementation, the constraint on the stiffness of the actuator can be defined as an acceptable range for the average of the pressures in the two chambers 2 and 3. In such implementation, the processing unit 16 computes the average of the two pressures measured by the pressure sensors 14*a-b* and compares it to the constraint. The processing unit 16 then computes two control signals and communicates the signals to activate two out of the four I/P transducers 20*a-d*.

Only one transducer needs to be activated for each pneumatic chamber at a given time in order to change the pressure in the chamber. Therefore, two control signals computed by the processing unit 16 are sufficient, as they can activate two of the four transducers 20*a-d* for each new control action. I/P transducers 20*a* and 20*b* activate, respectively, the supply and exhaust of the upper pneumatic chamber 2 of the actuator 1. I/P transducers 20*c* and 20*d* activate, respectively, the supply and exhaust of the lower pneumatic chamber 3 of the actuator 1. In one implementation, positive control signals can activate 20*a* and 20*c*, while negative control signals can activate 20*b* and 20*d*. The pneumatic amplifiers 24*a-d* amplify the flow rates of the transducers. The pneumatic summation components 27 and 28 connect the flow to the outlets of the pneumatic chambers 2 and 3. Active I/P transducer 20*a* results in control fluid flowing into chamber 2. Active I/P transducer 20*b* results in control fluid flowing out of chamber 2. Active I/P transducer 20*c* results in control fluid flowing into chamber 3. Active I/P transducer 20*d* results in control fluid flowing out of chamber 3. Another implementation may use only two I/P transducers if each is configured to control bi-directional flow.

Figure 2:
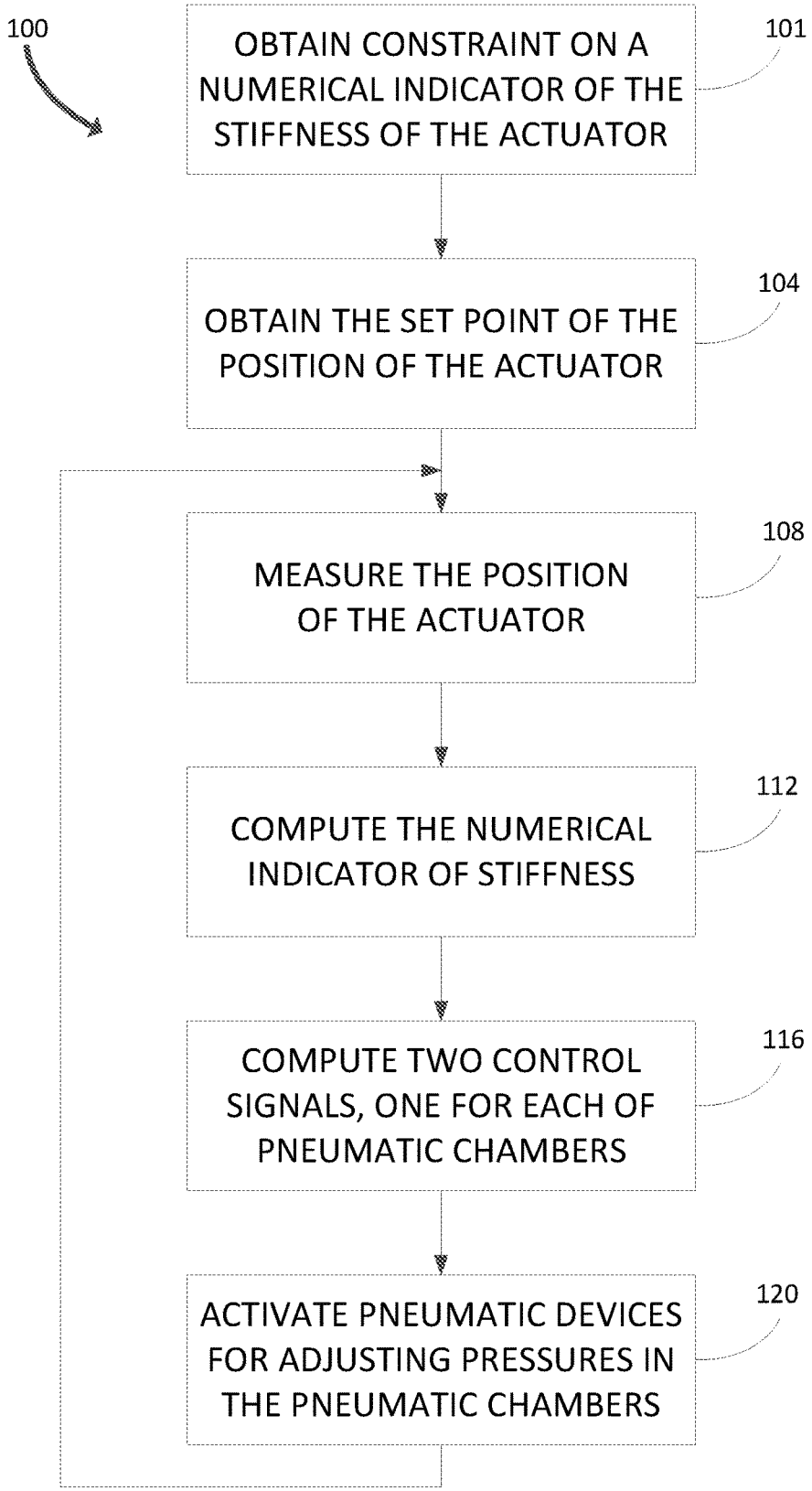
FIG. 2 is a flow diagram description of an example method for controlling an actuator in view of a constraint on the stiffness of the actuator.

FIG. 2 illustrates an example method 100 for controlling the position of the double-acting actuator 1 in view of the stiffness constraint. The method 100 can be implemented as a set of software or firmware instructions and executed by the processing unit 16 within the system in FIG. 1 or other similar systems.

At block 101, the stiffness constraint is obtained. In one implementation, the stiffness constraint can be preset by the manufacturer of the positioner 10, while in another it can be preset by any operator with appropriate access privileges. Additionally, an operator or engineer can change the stiffness constraint in response to process requirements or changes detected in the process control equipment. The changes in the stiffness constraint can be communicated to the interface 18 by means of a predetermined communication protocol. The stiffness constraint may be specified in terms of a constraint on a numerical indicator of stiffness, the indicator calculated in a predetermined way depending on implementation. In one implementation, this indicator can be specified to reflect variations of actuator position, as measured by the position sensor 11. In another implementation, the indicator can be specified in terms of a combination, such as a weighted sum, of the pressures in the two chambers 2 and 3, measured by the pressure sensors 14*a-b*. Also, the position of the actuator can be combined with the pressures to arrive at an indicator of stiffness. In some implementations, the constraint on the indicator of stiffness may be dependent on available supply pressure.

At block 104, the processing unit 16 obtains the set point of the position. The set point can be the most recent value communicated to the interface 18 by a process controller or it can be a value stored by the interface in response to operator input. At block 108, the processing unit 16 reads the current value of the measured position from sensor 11. At block 112, the processing unit 16 computes the numerical indicator of stiffness. This computation corresponds to the way that the constraint on stiffness is specified. In one implementation, for example, the numerical indicator of stiffness can be calculated as an average of the pressures in the two chambers 2 and 3, and the constraint can be specified as an acceptable range of this average. In such implementation, block 112 comprises reading the pressures measured by sensors 14*a* and 14*b*, from which the average is computed. Another implementation may compute the numerical indicator of stiffness by adding the weighted pressures in the two chambers 2 and 3 in order to account for some asymmetry in the actuator. Such asymmetry could be due to the presence of springs in the actuator, or because of the difference in the area of the piston exposed to pressure in each chamber. For an implementation in which the numerical indicator of stiffness is computed by other means, only the sensors which measure the quantities involved in the computation need to be read, though other sensors may also be read. For example, the processing unit 16 can collect statistics on the variation of the position of the actuator in the absence of control signals in order to compute the numerical indicator of stiffness.

At block 116, the processing unit 16 computes the control signals. The processing unit 16 uses the computed control signals to activate the I/P transducers at block 120. In the illustrated implementation of FIG. 1, only two transducers need to be activated at a given time. One can compute two control signals that control whether the pressure in the upper chamber should be increased or decreased, whether the pressure in the lower chamber should be increased or decreased, and the rates at which these pressure changes should take place. For example, a negative control signal for the upper chamber 2 can indicate that the pressure in the upper chamber will be lowered and lead to the activation of the corresponding I/P transducer 20*b*. At the same time, the distinct control signal for the lower chamber 3 can take on either a positive or a negative value in order to, respectively, increase or decrease the pressure in the lower chamber. The positioner 10 may lower both pressures simultaneously in order to reduce the stiffness of the actuator. The relative rates of the pressure changes in the chambers would then set the direction of the change in the actuator position.

Control signals at block 116 can be calculated in a variety of different ways in different implementations. In a simple implementation, the pressures in both chambers 2 and 3 are reduced by a control action if the computed indicator of stiffness is too high with respect to the constraint, and, conversely, the pressures in both chambers are increased by a control action if the computed indicator of stiffness is too low with respect to the constraint. In such implementation, the change in position is set by the difference in the rates at which the two pressures are raised or lowered. In another implementation, the stiffness constraint obtained in 101 is a set point for the numerical indicator of stiffness, and the control signals are computed by a control algorithm which treats this set point as another input to the control loop, along with actuator position. Because there are two control signals as well as two input signals, this implementation employs Multiple Input Multiple Output (MIMO) control.

Figure 3:
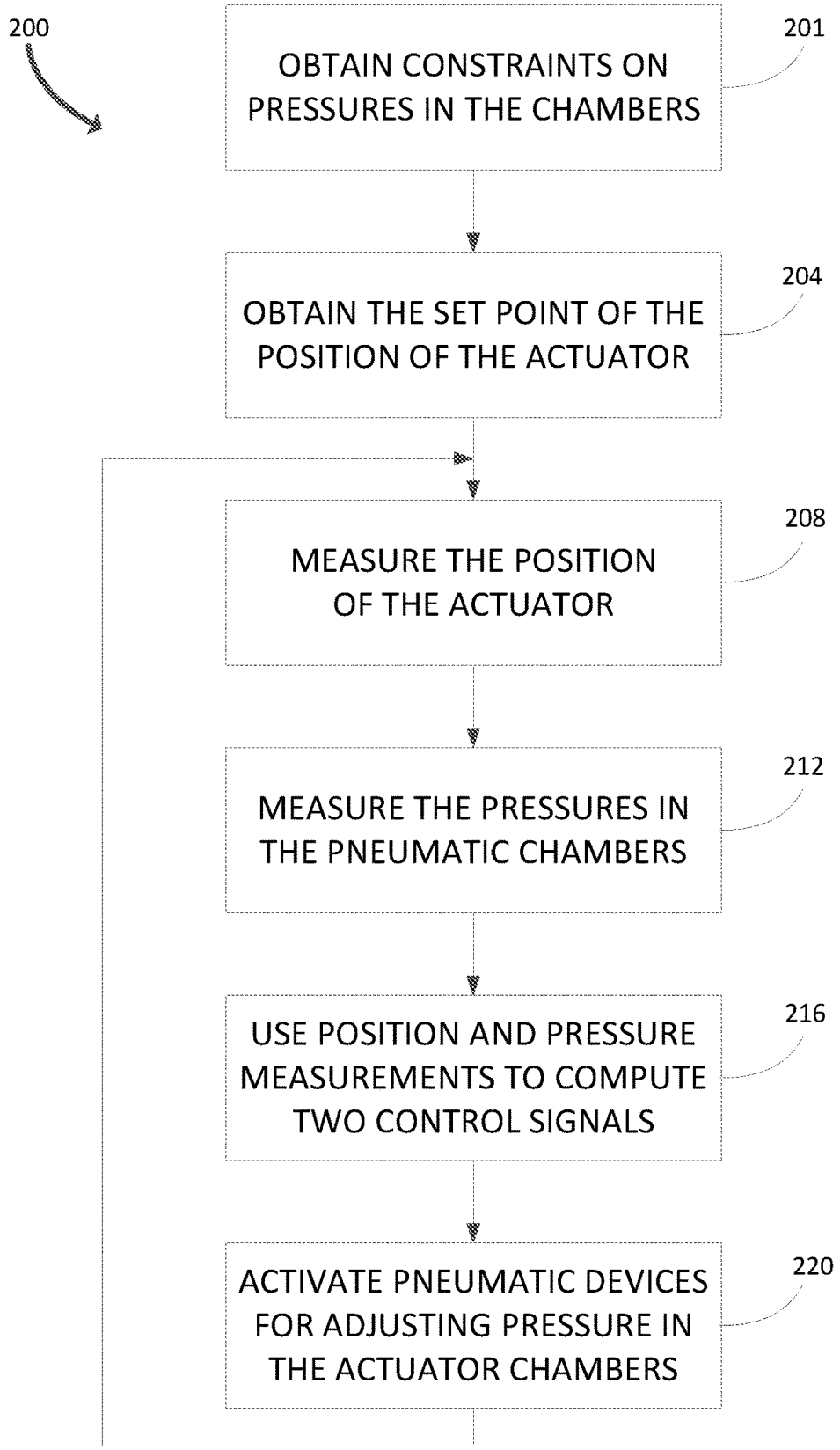
FIG. 3 is a flow diagram of an example method for controlling an actuator by incorporating measured chamber pressures into a control loop.

FIG. 3 illustrates an alternative method 200 for controlling the position of the double-acting actuator in which the measurements of pressures are used directly in the computation of control signals. At blocks 201 and 204, the processing unit 16 obtains the constraints on pressures and on the position of the actuator, respectively. In one possible implementation, the constraint on pressure may take form of a minimum pressure in one or both of the chambers 2 and/or 3. In another implementation, the constraint on pressure may comprise maximum pressure in one or both of the chambers. The constraint on pressure may comprise pressure set points in one or both of the chambers. If the set points in both chambers are given, the control algorithm can be allowed to settle to one of the two chamber set points, while treating the accompanying pressure of the other chamber for diagnostic purposes. Alternatively, the control algorithm can minimize the mean square error in the pressures of the two chambers. Also, the two pressures can be mathematically combined to create a single indicator, resulting in an approach analogous to computing the numerical indicator of stiffness.

The processing unit 16 obtains the measurements of the position of the actuator and the pressures in the chambers at blocks 208 and 212, respectively. At block 216, the processing unit 16 computes the control signals based on the position and pressure measurements, as well as the associated set points or constraints. In one example, if a pressure measurement in chamber 2 of FIG. 1 approaches a minimum value, the control signal would increase the pressure in chamber 2, while, possibly, increasing the pressure in chamber 3 even more, if the position set point is above the current position of the stem 5. At block 220, analogously to block 120, the control signals are translated into pneumatic control via the I/P actuators 20*a-d*.

Figure 4:
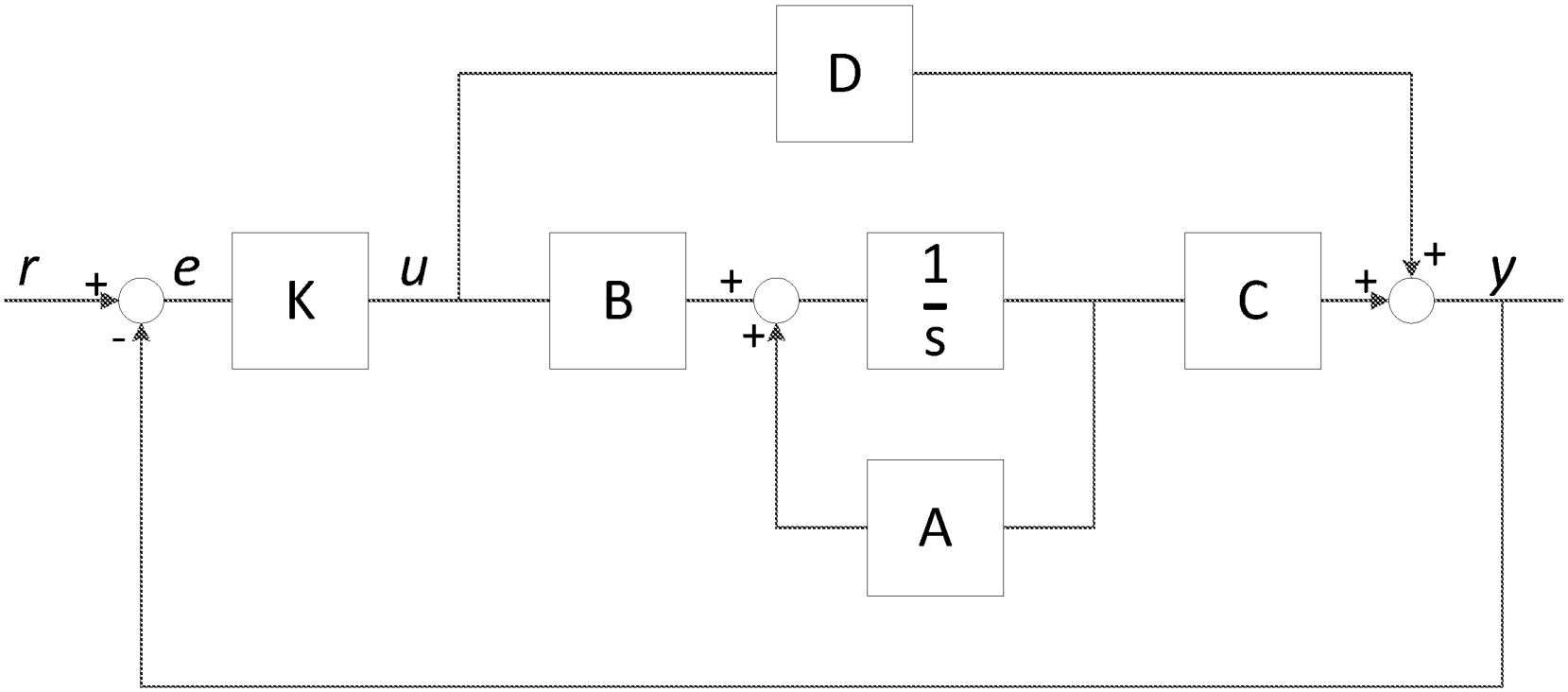
FIG. 4 is a diagram of the state-space description of an actuator control loop.

The control loop for implementing the MIMO implementation of the process in FIG. 2 can be represented in the state-space form illustrated in FIG. 4. The general form is also the same for the MIMO implementation of the process in FIG. 3, where pressure set points can be used in the control loop. In FIG. 4, the set point input signals are contained in an input vector r. The error vector e is computed by subtracting the output vector y from r. The error vector is then multiplied by the gain matrix K, to obtain the control signals in vector u. The integrating block 1/s, the system matrix A, the input matrix B, the output matrix C and the feed-through matrix D describe the effect of the control signals u on the output y. The reference vector r and the output vector y need to comprise the same parameters of the system. These parameters include the actuator position, and, in the implementation in which the stiffness is simultaneously controlled, a numerical indicator of stiffness. The parameters can also include the velocity of the actuator, with the reference of the velocity usually set to zero.

The control signals can be computed as weighted sums of the errors in position and the stiffness indicator. In another implementation of this computation, one can add a factor for the velocity of the actuator, which can also be interpreted as the rate of change in the position error and can be computed using the difference in consecutive measurements of position. The resulting control signal can then be written as:

$$C_a = K_{p,a}e_x - K_{v,a}e_{\dot{x}} - K_{s,a}e_s$$

$$C_b = -K_{p,b}e_x + K_{v,b}e_{\dot{x}} - K_{s,b}e_s$$

where $C_a$ is the control signal for the upper chamber, $C_b$ is the control signal for the lower chamber, $K_{p,a}$ and $-K_{p,b}$ are the position feedback gains for chambers, $-K_{v,a}$, $K_{v,b}$ are the velocity feedback gains, $-K_{s,a}$, $-K_{s,b}$ are the feedback grains for the indicator of stiffness, $e_x$ is the error in the position, $e_{\dot{x}}$ can be interpreted as rate of change of the error in position, or simply, as the velocity of the actuator and $e_s$ is the error in a numerical indicator of stiffness. In some implementations, the numerical indicator of stiffness may be replaced by a pressure indicator, and $e_s$ is then replaced by the error in the pressure indicator, $e_p$.

Control signals $C_a$ and $C_b$ can be computed in a variety of ways different from the weighted sum of the errors. For example, the feedback gains can change values depending on the errors or other process parameters. Also, terms proportional to errors raised to integer or non-integer powers can be included in the computation of errors.

The effect of control signals $C_a$ and $C_b$ on the I/P transducers depends on a given implementation. In one implementation, analog I/P transducers can be used, and the control signals can set the magnitude of flow rates into or out of the corresponding chambers, with the flow rate magnitudes, for example, proportional to the control signals. In another implementation, especially suitable for digital I/P transducers, the duration of a fixed flow rate is controlled. For example, if $C_a$ is positive, while $C_b$ is negative, but its absolute value is twice that of $C_a$, then I/P transducers 20*a* and 20*d* in FIG. 1 are activated with 20*d* activated for twice the duration of 20*a*. The resulting increase in the amount of the control fluid in chamber 2 and the decrease in the control fluid in chamber 3 both contribute to the downward movement of the piston 4 and the stem 5. Additionally, if the decrease in the control fluid amount in chamber 3 is greater than the increase in chamber 2, the stiffness of the actuator can decrease.

The control of flow rate durations, as opposed to the flow rate magnitudes, is particularly applicable to the implementation of a control method in which the control actions are updated at pre-defined intervals. The fraction of the interval during which a given flow path is active can be proportional to the magnitude of the corresponding control signal, the magnitude determining the duration of an electrical pulse to the associated I/P transducer.

ADDITIONAL CONSIDERATIONS

The foregoing detailed description has been given for clearness of understanding only, and no unnecessary limitations should be understood therefrom, as modifications will be obvious to those skilled in the art. Additionally, throughout this specification, plural instances may implement components, operations, or structures described as a single instance. Although individual operations of one or more methods are illustrated and described as separate operations, one or more of the individual operations may be performed concurrently or may be performed in an alternate order to the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Throughout this specification, actions described as performed by the processing unit 16 or other similar devices (or routines or instructions executing thereon) generally refer to actions or processes of a processor manipulating or transforming data according to machine-readable instructions. The machine-readable instructions may be stored on and retrieved from a memory device communicatively coupled to the processor. That is, methods described herein may be embodied by a set of machine-executable instructions stored on a non-transitory computer readable medium (i.e., on a memory device). The instructions, when executed by one or more processors of a corresponding device (e.g., a server, a mobile device, etc.), cause the processors to execute the method. Where instructions, routines, modules, processes, services, programs, and/or applications are referred to herein as stored or saved on a computer readable memory or on a computer readable medium, the words "stored" and "saved" are intended to exclude transitory signals.

Unless specifically stated otherwise, discussions herein using words such as "processing," "computing," "calculating," "determining," "identifying," "presenting," "displaying," or the like may refer to actions or processes of a machine (e.g., a computer) that manipulates or transforms data represented as physical (e.g., electronic, magnetic, or optical) quantities within one or more memories (e.g., volatile memory, non-volatile memory, or a combination thereof), registers, or other machine components that receive, store, transmit, or display information.

When implemented in software, any of the applications, services, and engines described herein may be stored in any tangible, non-transitory computer readable memory such as on a magnetic disk, a laser disk, solid state memory device, molecular memory storage device, or other storage medium, in a RAM or ROM of a computer or processor, etc. Although the example systems disclosed herein are disclosed as including, among other components, software and/or firmware executed on hardware, it should be noted that such systems are merely illustrative and should not be considered as limiting. For example, it is contemplated that any or all of these hardware, software, and firmware components could be embodied exclusively in hardware, exclusively in software, or in any combination of hardware and software.

Accordingly, persons of ordinary skill in the art will readily appreciate that the examples provided are not the only way to implement such systems.

Thus, while the present invention has been described with reference to specific examples, which are intended to be illustrative only and not to be limiting of the invention, it will be apparent to those of ordinary skill in the art that changes, additions or deletions may be made to the disclosed embodiments without departing from the spirit and scope of the invention.

What is claimed is:

1. A method of controlling a double-acting pneumatic actuator, the actuator comprising an actuated piston and two pneumatic chambers, wherein pressure in one chamber exerts a force on a piston in one direction, while pressure in the other chamber exerts a force on the piston in the opposite direction, and the method of controlling the actuator comprising:

obtaining a constraint on a numerical indicator of the stiffness of the actuator, and obtaining a set point for a position of the actuator;

measuring the position of the actuator;

computing the numerical indicator of the stiffness of the actuator;

computing control signals to adjust the pressures in the two pneumatic chambers in view of the constraint, including computing, for each of the control signals, a weighted sum of (i) an error in the position of the actuator, (ii) a velocity of the actuator, and (iii) an error in the numerical indicator of the stiffness of the actuator, in view of the constraint, to simultaneously minimize the error in the position of the actuator and the error in the numerical indicator of the stiffness of the actuator; and activating pneumatic devices to adjust the pressures in the pneumatic chambers of the actuator in response to the control signals;

wherein: computing control signals to adjust pressures in the two pneumatic chambers so as to minimize the error in the position of the actuator in view of the constraint on the numerical indicator of the stiffness of the actuator comprises computing a first control signal as:

$$C_a=K_{p,a}e_x-K_{v,a}e_{\dot{x}}-K_{s,a}e_s$$

where $C_a$ is the first control signal, $K_{p,a}$ is a feedback gain for a first chamber of the pneumatic chambers, $-K_{v,a}$ is a velocity feedback gain, $-K_{s,a}$ is a feedback gain for the numerical indicator of stiffness, $e_x$ is the error in the position, $e_{\dot{x}}$ is a derivative of the error in the position, and $e_s$ is the error in a numerical indicator of stiffness.

2. The method of claim 1, further comprising:

measuring the pressures in each of the pneumatic chambers of the actuator; and using the measured pressures in computing the numerical indicator of the stiffness of the actuator.

3. The method of claim 2, comprising computing the numerical indicator of the stiffness of the actuator using a weighted sum of the pressures in the two pneumatic chambers.

4. The method of claim 2, comprising computing the numerical indicator of the stiffness of the actuator by averaging the pressures in the two pneumatic chambers.

5. The method of claim 1, wherein activating the pneumatic devices to adjust the pressures in the pneumatic chambers of the actuator in response to the control signals comprises activating each of the pneumatic devices to provide a constant flow rate for a duration consistent with the magnitude of the corresponding control signal.

6. A system for controlling a double-acting pneumatic actuator, the system comprising:

an interface configured to obtain a set point for a position of the actuator and to obtain a constraint on a numerical indicator of the stiffness of the actuator;

a position sensor configured to measure the position of the actuator;

two pressure sensors configured to measure pressures in each of two pneumatic chambers of the actuator, comprising a first sensor configured to measure a value indicative of pressure in the first chamber and a second sensor configured to measure a value indicative of pressure in the second chamber;

an electronic processing unit configured to compute the numerical indicator of the stiffness of the actuator using the measured values indicative of the pressures in the two pneumatic chambers and to compute control signals to adjust the pressures in the two pneumatic chambers in view of the constraint, including computing, for each of the control signals, a weighted sum of (i) an error in the position of the actuator, (ii) a velocity of the actuator, and (iii) an error in the numerical indicator of the stiffness of the actuator, in view of the constraint, to simultaneously minimize the error in the position of the actuator and the error in the numerical indicator of the stiffness of the actuator; and transducers to convert the electrical control signals to pneumatic control signals configured to adjust the pressures in the two pneumatic chambers of the actuator according to the control signals;

wherein: computing control signals to adjust pressures in the two pneumatic chambers so as to minimize the error in the position of the actuator in view of the constraint on the numerical indicator of the stiffness of the actuator comprises computing a first control signal as:

$$C_a=K_{p,a}e_x-K_{v,a}e_{\dot{x}}-K_{s,a}e_s$$

where $C_a$ is the first control signal, $K_{p,a}$ is a feedback gain for a first chamber of the pneumatic chambers, $-K_{v,a}$ is a velocity feedback gain, $-K_{s,a}$ is a feedback gain for the numerical indicator of stiffness, $e_x$ is the error in the position, $e_{\dot{x}}$ is a derivative of the error in the position, and $e_s$ is the error in a numerical indicator of stiffness.

7. The system of claim 6, wherein the interface for obtaining the constraint on the numerical indicator of the stiffness of the actuator comprises a means of selecting stored values for the constraint on the numerical indicator of the stiffness of the actuator.

8. A method of controlling a double-acting pneumatic actuator, the actuator comprising an actuated piston and two pneumatic chambers, wherein pressure in one of the two pneumatic chambers exerts a force on the piston in one direction, while pressure in the other of the two pneumatic chambers exerts a force on the piston in the opposite direction, comprising:

obtaining a set point for the position of the actuator;

measuring a position of the actuator;

measuring sensor outputs indicative of pressures in the two pneumatic chambers of the actuator;

obtaining constraints on values of the pressures in the two pneumatic chambers;

using the measured position and the measured pressures in computing control signals in view of the constraints, including computing, for each of the control signals, a weighted sum of (i) an error in the position of the actuator, (ii) a velocity of the actuator, and (iii) an error in the numerical indicator of the stiffness of the actuator, in view of the constraints, to simultaneously minimize the error in the position of the actuator and the error in the numerical indicator of the stiffness of the actuator; and activating pneumatic devices to adjust the pressures in the two pneumatic chambers of the actuator in response to the control signals;

wherein: computing control signals to adjust pressures in the two pneumatic chambers so as to minimize the error in the position of the actuator in view of the constraint on the numerical indicator of the stiffness of the actuator comprises computing a first control signal as:

$$C_a = K_{p,a}e_x - K_{v,a}\dot{e}_x - K_{s,a}e_s$$

where $C_a$ is the first control signal, $K_{p,a}$ is a feedback gain for a first chamber of the pneumatic chambers, $-K_{v,a}$ is a velocity feedback gain, $-K_{s,a}$ is a feedback gain for the numerical indicator of stiffness, $e_x$ is the error in the position, $\dot{e}_x$ is a derivative of the error in the position, and $e_s$ is the error in a numerical indicator of stiffness.

9. The method of claim 8, wherein:

the constraints on the values of the pressures in the two pneumatic chambers comprise a minimum value on the pressure or pressures in one or both of the two pneumatic chambers; and computing the control signals to adjust the pressures in the two pneumatic chambers so as to minimize the error in the position of the actuator in view of the constraints on the pressures in the two chambers comprises preventing the pressure or pressures in the one or both of the two pneumatic chambers from falling below the minimum value.

10. The method of claim 8, wherein:

the constraints on the values of the pressures in the two pneumatic chambers comprise a maximum value on the pressure or pressures in one or both of the two pneumatic chambers; and computing the control signals to adjust the pressures in the two pneumatic chambers so as to minimize the error in the position of the actuator in view of the constraints on the pressures in the two chambers comprises preventing the pressure or pressures in the one or both of the two pneumatic chambers from rising above the maximum value.

11. The method of claim 8, wherein the constraints on the values of the pressures in the two pneumatic chambers comprise a set point for the pressure or pressures in one or both of the two pneumatic chambers; and computing the control signals to adjust the pressures in the two pneumatic chambers so as to minimize the error in the position of the actuator in view of the constraints on the pressures in the two chambers comprises minimizing the error in the position and an error in the pressure in at least one of the two pneumatic chambers.

12. The method of claim 8, wherein:

the constraints on the values of the pressures in the two pneumatic chambers comprise set points for the pressures in both of the two pneumatic chambers; and computing the control signals to adjust the pressures in the two pneumatic chambers so as to minimize the error in the position of the actuator in view of the constraints on the pressures in the two chambers comprises minimizing the error in the position and a mean square error in the pressures in the two pneumatic chambers.

13. The method of claim 8, wherein:

the constraints on the values of the pressures in the two pneumatic chambers comprise a set point value for an indicator of pressure computed from the pressures in the two pneumatic chambers; and computing the control signals to adjust the pressures in the two pneumatic chambers so as to minimize the error in the position of the actuator in view of the constraints on the pressures in the two pneumatic chambers further comprises minimizing an error in the computed indicator of pressure.

14. The method of claim 8, wherein activating the pneumatic devices to adjust the pressures in the two pneumatic chambers of the actuator in response to the control signals comprises activating each of the pneumatic devices to provide a constant flow rate for a duration consistent with the magnitude of the corresponding control signal.

15. The method of claim 1, wherein computing control signals includes applying an input vector containing set point input signals and a gain matrix to implement a multiple-input, multiple-output (MIMO) control.

16. The system of claim 6, wherein computing control signals includes applying an input vector containing set point input signals and a gain matrix to implement a multiple-input, multiple-output (MIMO) control.

* * * * *